US005427256A

United States Patent [19]

Kleppe

[11] Patent Number: 5,427,256

[45] Date of Patent: Jun. 27, 1995

[54] CRANE UPPER WORKS TO LOWER WORKS ALIGNMENT SYSTEM

[75] Inventor: Terry W. Kleppe, Manitowoc, Wis.

[73] Assignee: The Manitowoc Company, Inc., Manitowoc, Wis.

[21] Appl. No.: 762,765

[22] Filed: Sep. 20, 1991

[51] Int. Cl.[6] ..... B66C 23/18; B66C 23/78

[52] U.S. Cl. ..... 212/179; 212/270; 212/175; 212/180; 414/496; 414/786

[58] Field of Search ..... 212/270, 175, 179, 180, 212/176, 178, 181, 146, 152, 253; 254/399–405; 414/495, 498, 786; 29/429, 468, 897, 464; 294/81.1, 81.5, 81.55; 52/122.1, 123.1, 124.2, 125.2

[56] References Cited

U.S. PATENT DOCUMENTS

| | | | |
|---|---|---|---|
| 1,436,608 | 11/1922 | Rodier | 254/399 |
| 2,136,255 | 11/1938 | Scanlon | 254/399 |
| 2,965,245 | 12/1960 | Zeilman et al. . | |
| 2,973,942 | 3/1961 | Schaper | 254/399 |
| 3,624,784 | 11/1971 | Larson et al. . | |
| 3,726,418 | 4/1973 | Short . | |
| 3,921,817 | 11/1975 | Petrik et al. . | |
| 3,923,407 | 12/1975 | Jensen et al. . | |
| 3,941,252 | 3/1976 | Six et al. . | |
| 4,000,784 | 1/1977 | Morrow, Sr. et al. . | |
| 4,014,400 | 3/1977 | Cline et al. . | |
| 4,195,740 | 4/1980 | Beduhn et al. . | |
| 4,248,488 | 2/1981 | Sable . | |
| 4,273,244 | 6/1981 | Jensen et al. . | |
| 4,436,444 | 3/1984 | Scherrer . | |
| 4,478,340 | 10/1984 | Delago et al. . | |
| 4,508,232 | 4/1985 | Lampson | 212/189 |
| 4,508,232 | 4/1985 | Lampson . | |
| 4,601,401 | 7/1986 | Wittman et al. | 212/180 |
| 4,632,261 | 12/1986 | Cuhel . | |
| 4,632,262 | 12/1986 | Olsen et al. . | |
| 4,640,421 | 2/1987 | Mason | 212/175 |
| 4,662,527 | 5/1987 | Cuhel | 212/180 |
| 4,700,851 | 10/1987 | Reeve et al. | 212/181 |
| 5,016,422 | 5/1991 | Popp et al. | 29/468 |
| 5,176,267 | 1/1993 | Pech | 212/180 |

FOREIGN PATENT DOCUMENTS

| | | | |
|---|---|---|---|
| 2333743 | 1/1977 | France | 212/178 |
| 2388755 | 11/1978 | France . | |
| 2841378 | 4/1980 | Germany | 212/180 |
| 397470 | 1/1974 | U.S.S.R. | 254/399 |
| 525611 | 6/1975 | U.S.S.R. | 212/205 |
| 979254 | 11/1982 | U.S.S.R. | 294/81.55 |

OTHER PUBLICATIONS

American Series 1000 Brochure, published by The American Hoist & Derrick Company, publication date unknown.

Link-Belt Model HC-268 Lattice Boom Truck Crane Brochure, published by FMC Corporation, publication date unknown.

Manitowoc Model 3900T Brochure, published by The Manitowoc Company, p. 7, published 1976.

Sumitomo Model LS-368RH5 Brochure, published by The Sumitomo Company, publication date unknown.

Harvey J. Sable, *Solving The Quick-Disconnect Problem For Big Bearings*, Machine Design, Jul. 7, 1983, at 91.

*Primary Examiner*—David A. Bucci
*Assistant Examiner*—R. B. Johnson
*Attorney, Agent, or Firm*—Steven P. Shurtz; Willian Brinks Hofer Gilson & Lione

[57] ABSTRACT

A system and method for aligning the upper works assembly to the lower works assembly of a crane to facilitate redecking of the assemblies. The system and method involves suspending, preferably by pendants, the lower works from the upper works in such a manner that the influence of gravity will automatically level and align the lower works with the upper works. Alignment and redecking are accomplished without transferring the weight of the upper works assembly to lower works assembly.

20 Claims, 7 Drawing Sheets

CRANE UPPER WORKS TO LOWER WORKS ALIGNMENT SYSTEM

BACKGROUND OF THE INVENTION

The present invention relates to construction equipment, such as cranes, having an upper works assembly rotatively mounted on a lower works assembly, and more particularly to a method and an apparatus for aligning the upper works to the lower works during redecking of the assemblies.

Construction equipment, such as cranes or excavators, often must be moved from one job site to another. Moving a crane or excavator can be a formidable task when the machine is large and heavy. For example, highway limits on vehicle-axle loads must be observed and overhead obstacles can dictate long, inconvenient routings to a job site.

One solution to improving the mobility of large construction machines is to disassemble them into smaller, more easily handled components. This typically involves undecking (separating) the upper works assembly from the lower works assembly. For larger cranes, further disassembly of the upper works and the lower works may be required. The individual components can then be transported separately to the job site where they are reassembled.

The typical past practice has been to undeck the upper works from the lower works with an outside assist crane. As the upper works assembly for a larger capacity crane may weigh as much as 80,000 lbs., the capacity of the assist crane required represents a very significant transport expense.

As a result, designers have attempted to develop self-handling (self undecking) systems. One such system uses a saddle and counterweights to temporarily support the upper works assembly while the lower works assembly is maneuvered into position underneath the upper works. Another system employs a series of hydraulic jacks that support the upper works assembly during redecking. For examples of previously patented self handling systems, see U.S. Pat. Nos. 4,662,527; 4,632,262; 4,632,261; 4,273,244 and 3,624,784.

The disassembly of a conventional crane can also be both labor-intensive and time-consuming, adding additional expense to the undecking and redecking operations. This is primarily due to the large number of high-strength fasteners connecting the upper works assembly to the lower works assembly.

To overcome this problem, several quick disconnect systems have been developed. Several such machine designs, many of which are patented, are disclosed in an article entitled "Solving The Quick-Disconnect Problem For Big Bearings" in the Jul. 7, 1983 issue of *Machine Design*. For examples of previously patented approaches to solving this problem, see U.S. Pat. Nos. 4,478,340; 4,436,444; 4,248,488; 3,941,252; 3,923,407; 3,921,817; 3,726,418 and 2,965,245.

Finally, crane redecking can present alignment difficulties as well. In a conventional crane, the bearing bolt holes in the upper works assembly must be aligned precisely with the mounting-surface holes in the lower works assembly during redecking of the crane. Cranes employing quick disconnect systems which undeck at the swing bearing also require precise longitudinal, transverse and vertical alignment.

When redecking is performed with an assist crane, the assist crane operator must maneuver the suspended upper works assembly into transverse and longitudinal alignment with the lower works. When redecking is performed with a self handling system, the driver transporting the lower works assembly must maneuver the lower works underneath and into transverse and longitudinal alignment with the temporarily supported upper works. Because the separate assemblies are large and heavy, such alignments can be unwieldy and time consuming. Uneven terrain can aggravate the problem. Moreover, neither method provides for vertical alignment of the separate assemblies.

One approach to solving the alignment problem for self handling systems is disclosed by U.S. Pat. No. 4,601,401. The patent discloses an alignment system which uses a plurality of centering pins and sockets. As the centering pins engage the sockets, the upper works assembly is forced to translate into alignment.

This system has several disadvantages. First, floats must be provided under each of the jacks supporting the upper works assembly to allow lateral displacement of the upper works during alignment. These floats are expensive and create an inherent instability in the structure during redecking, particularly on uneven terrain. Second, the transport trailer which supports the lower works during redecking is forced to carry the weight of the upper works during alignment. The combined weight of the upper works and the lower works will often exceed the carrying capacity of the transport trailer. Third, after the assemblies have been aligned, the upper works must be raised in order to retract the pins, adding an additional step to the redecking operation. Finally, the system does not provide for vertical alignment of the assemblies.

SUMMARY OF THE INVENTION

A method and system for aligning the upper works assembly to the lower works assembly of a crane to facilitate redecking has been invented which overcomes the deficiencies noted above and has other advantages. The method involves suspending the lower works from the upper works in such a manner that the influence of gravity will automatically level and align the lower works with the upper works. Furthermore, alignment and redecking may be accomplished without transferring any of the weight of the upper works assembly onto the lower works assembly. The system used in the above method to suspend the lower works and achieve alignment preferably comprises a plurality of pendants pivotally connected between the two assemblies.

In the preferred embodiment, the upper works is first supported in a generally level manner on a plurality of hydraulic jacks. The lower works is then placed beneath and in general alignment with the upper works. A plurality of flexible wire rope pendants are then pivotally connected between the upper works and the lower works. The upper works is then raised by extending the jacks to suspend the lower works by the pendants. The influence of gravity will then automatically align the suspended lower works longitudinally, transversely and vertically with the upper works. The upper works is then lowered to mate with the aligned lower works and complete redecking.

DETAILED DESCRIPTION OF THE PREFERRED EMBODIMENTS

The preferred embodiment of the present invention relates to a self-assembling crane, other aspects of which are disclosed in the following copending applications assigned to the assignee of the present application, being filed concurrently herewith unless otherwise specified:

"Self-Assembling and Self-Disassembling Crawler Crane", (Ser. No. 07/762,767);

"Multi-Coupling Device for Crane Hydraulic Lines", (Ser. No. 07/762,771), now U.S. Pat. No. 5,148,429;

"Quick-Connect Sectional Boom Members for Cranes and the Like", filed Jul. 25, 1991 (Ser. No. 7/736,029);

"Carbody to Crawler Connection", (Ser. No. 07/762,764).

"Easily Removable Sheave Assembly", (Ser. No. 07/762,766)

"Control and Hydraulic System for a Liftcrane", filed Oct. 10, 1989 (Ser. No. 07/418,879); and "Control and Hydraulic System for Liftcrane", filed Aug. 13, 1990 (Ser. No. 07/566,751), a continuation-in-part application of application Ser. No. 07/418,879.

The crane of the preferred embodiment also uses the swing lock mechanism disclosed in application Ser. No. 07/556,840, now U.S. Pat. No. 5,176,267. Each of these applications is hereby incorporated by reference.

Figure 1:
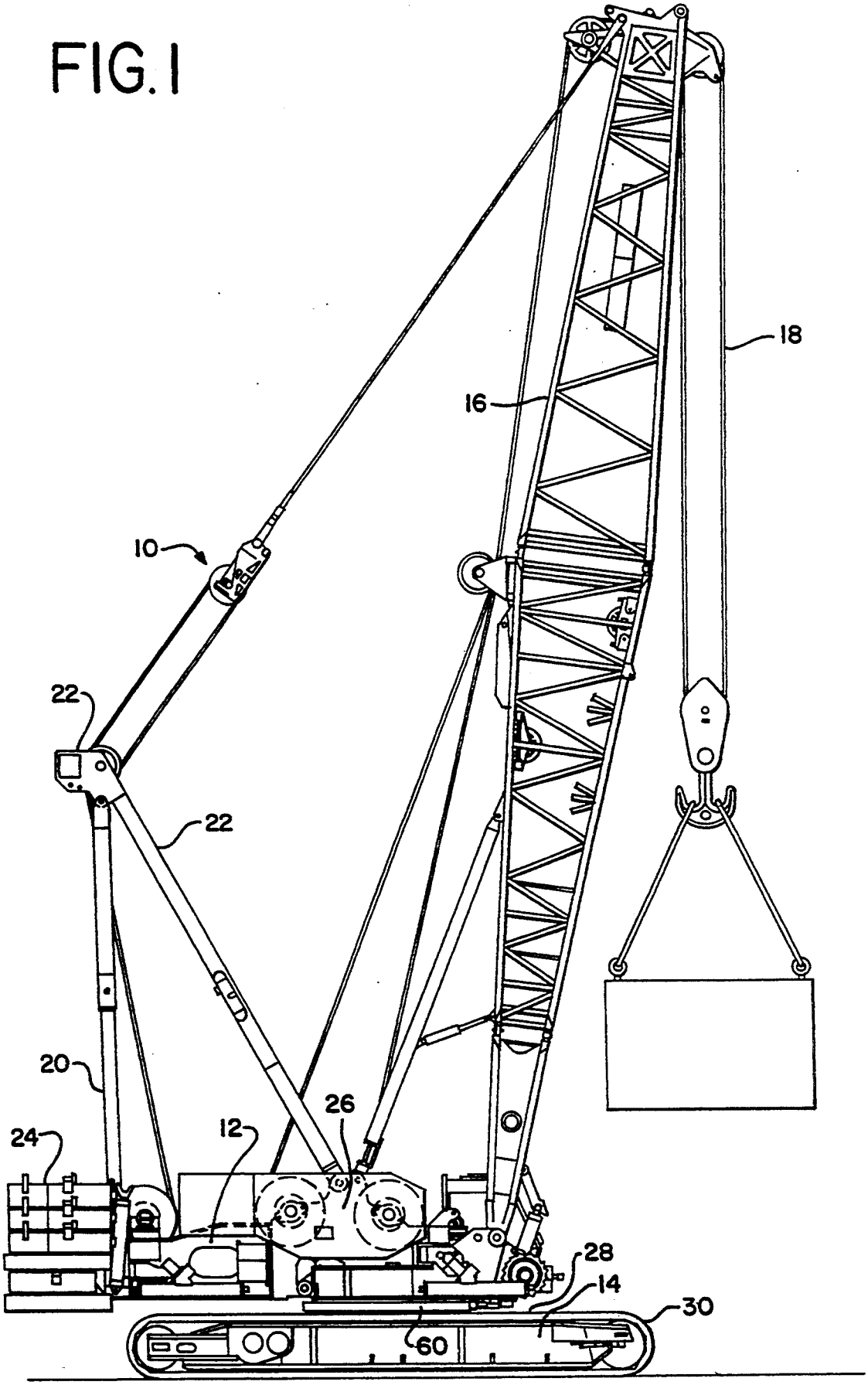
FIG. 1 is a right side perspective view of the complete crane.

While the present invention will find application in all types of construction equipment, the preferred embodiment of the invention is described in conjunction with the crawler crane 10 of FIG. 1. The crawler crane 10 includes an upper works 12 rotatively supported on a mobile lower works 14 by a swing bearing 60. The upper works 12 and the lower works 14 comprise conventional crane elements. The upper works 12 includes a boom 16 and rigging 18, a backhitch 20, a gantry 22, a counterweight 24 and power equipment (not shown) enclosed by a housing 26. The lower works 14 includes a car body 28 and two independently powered crawlers 30. Of course, the present invention will also apply to truck mounted cranes, which comprise the same basic components as a crawler crane 10 with the exception of wheels substituted for the crawler assemblies 30.

Figure 2:
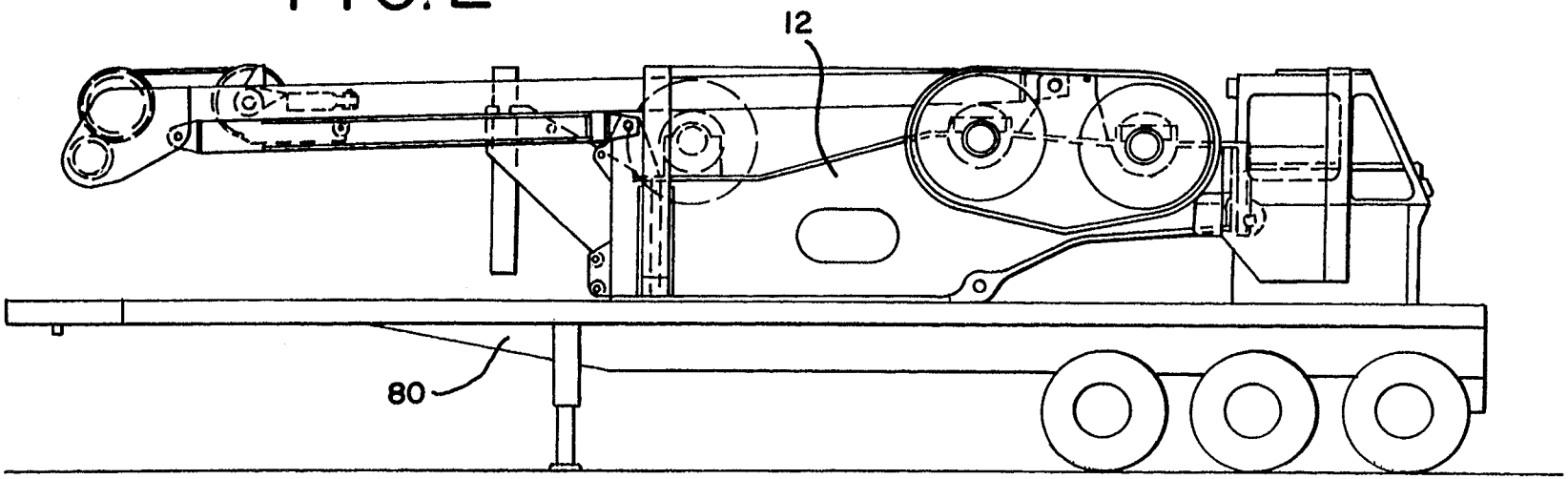
FIG. 2 is a right side perspective view of the upper works assembly resting on the upper works transport trailer.

As best seen in FIG. 2, the disassembled upper works 12 is brought to the job site on a upper works transport trailer 80 prior to redecking with the lower works 14 (not shown). The boom 16 and rigging 18, the counterweight 24 and the housing 26 have been disassembled and removed from the upper works 12 and are not shown. These components are typically transported to the job site separately and will be assembled to the crawler crane 10 after redecking of the upper works 12 with the lower works 14. The procedures for assembling the boom 16 and rigging 18, the counterweight 24 and the housing 26 to the crawler crane 10 are well known by those within the art and are not the subject of present invention.

Figure 3:
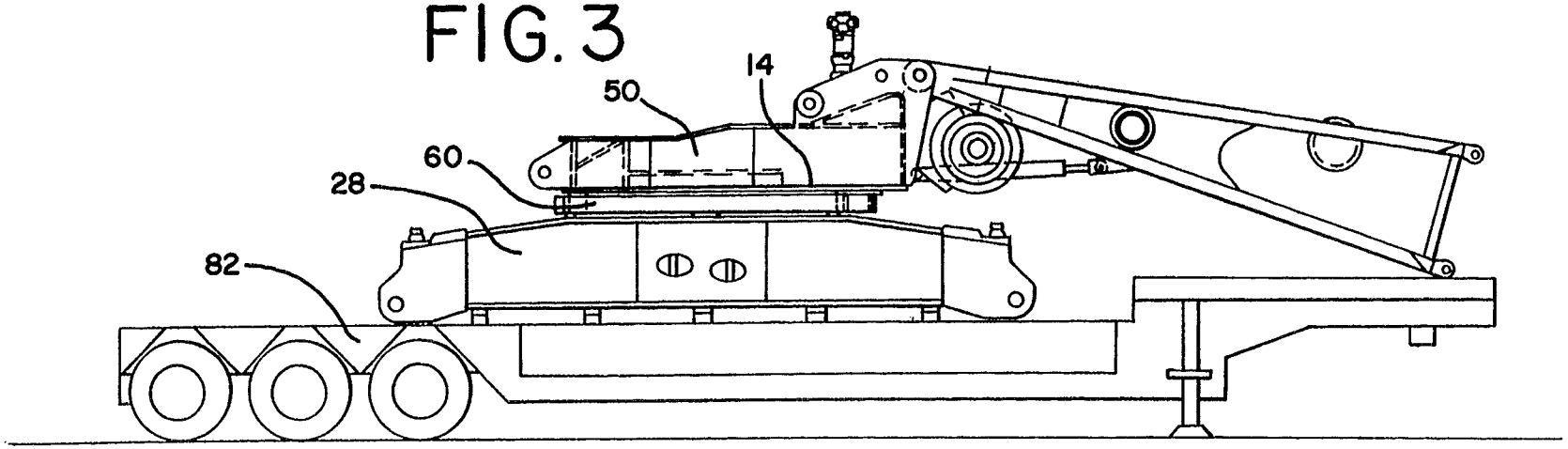
FIG. 3 is a right side perspective view of the lower works assembly resting on the lower works transport trailer.

As best seen in FIG. 3, the disassembled lower works 14 is brought to the job site on a lower works transport trailer 82 prior to redecking with the upper works 12 (not shown). In the preferred embodiment shown, an adapter frame 50 is attached to the swing bearing 60, which is in turn attached to the car body 28. As will be described below, the adapter frame 50 is designed to be releasably connected to the upper works 12 (not shown). The crawlers 30 have been disconnected and removed from the car body 28 and are not shown. The crawlers 30 are typically transported to the job site separately and are assembled to the car body 28 after redecking of the upper works 12 to the lower works 14. A method and apparatus for assembling the crawlers 30 to the car body 28 are disclosed in the aforementioned application entitled "Carbody to Crawler Connection," Ser. No. 07/762,764.

Figure 7:
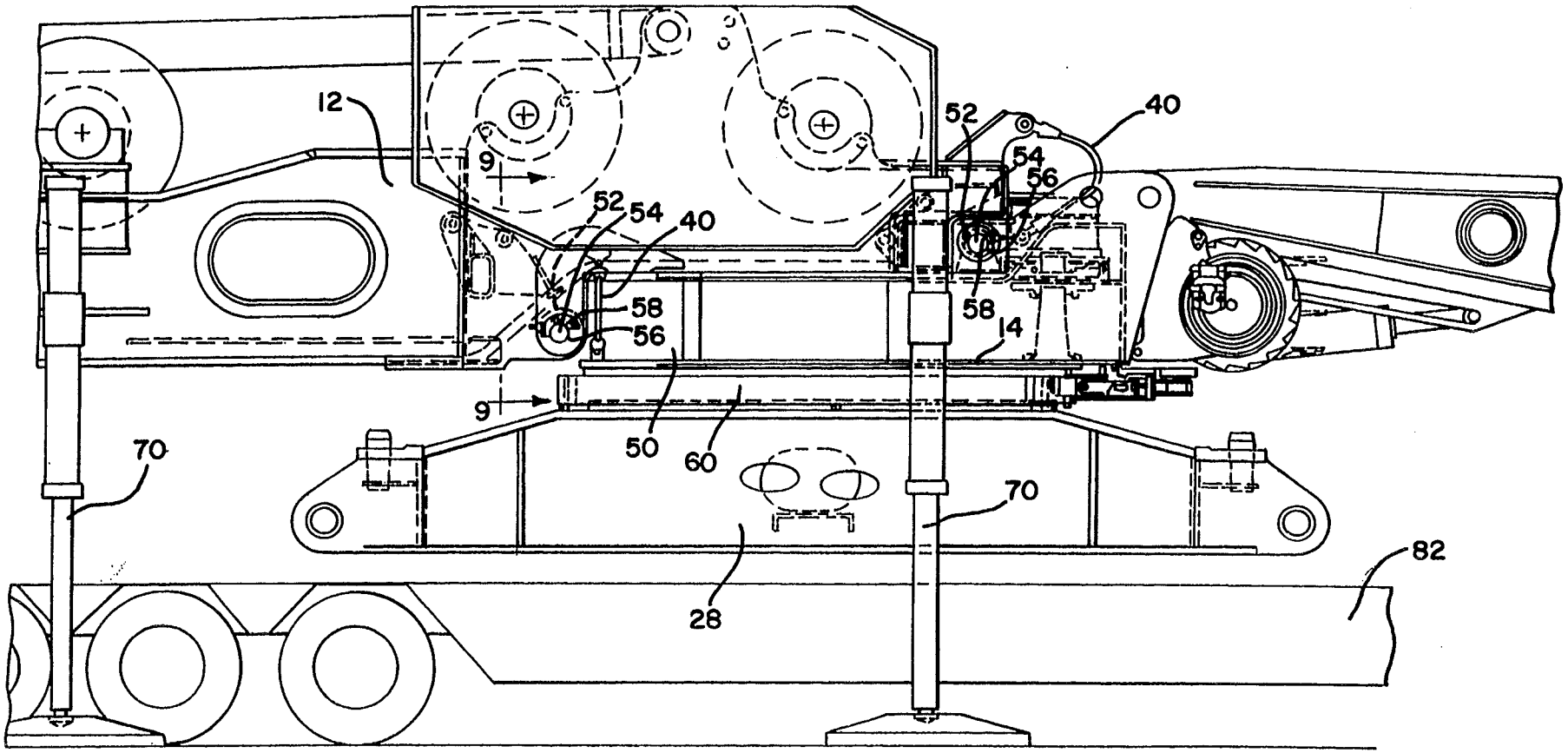
FIG. 7 is a right side perspective view of the upper works assembly redecked with the lower works assembly.
Figure 9:
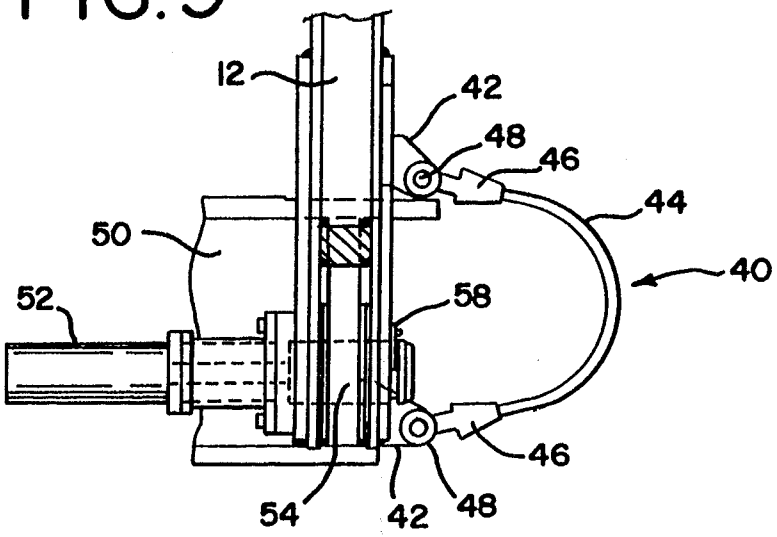
FIG. 9 is a sectional view of a rear pendant assembly taken along line 9—9 of FIG. 7.

As best seen in FIGS. 7 and 9, the upper works 12 is redecked with the lower works 14 by a releasably connecting means. In the preferred embodiment shown, the releasably connecting means comprises four pin-puller assemblies 52 mounted on the upper works 12, two on each side. Each of the pin-puller assemblies 52 has a hydraulically actuated movable pin 54. The adapter frame 50 has pinning holes 56 which are designed to receive each of the movable pins 54. When the upper works 12 is aligned and mated with the lower works 14, the hydraulically actuated movable pins 54 are extended to engage the pinning holes 56 to redeck the assemblies. A rotatably mounted latch plate 58 adjacent to each pinning hole 56 engages and locks the pin 54 in the extended position. Of course, the upper works 12 can be attached to the lower works 14 by any releasably connecting means. For instance, the upper works 12 could be bolted to the adapter frame 50.

Figure 6:
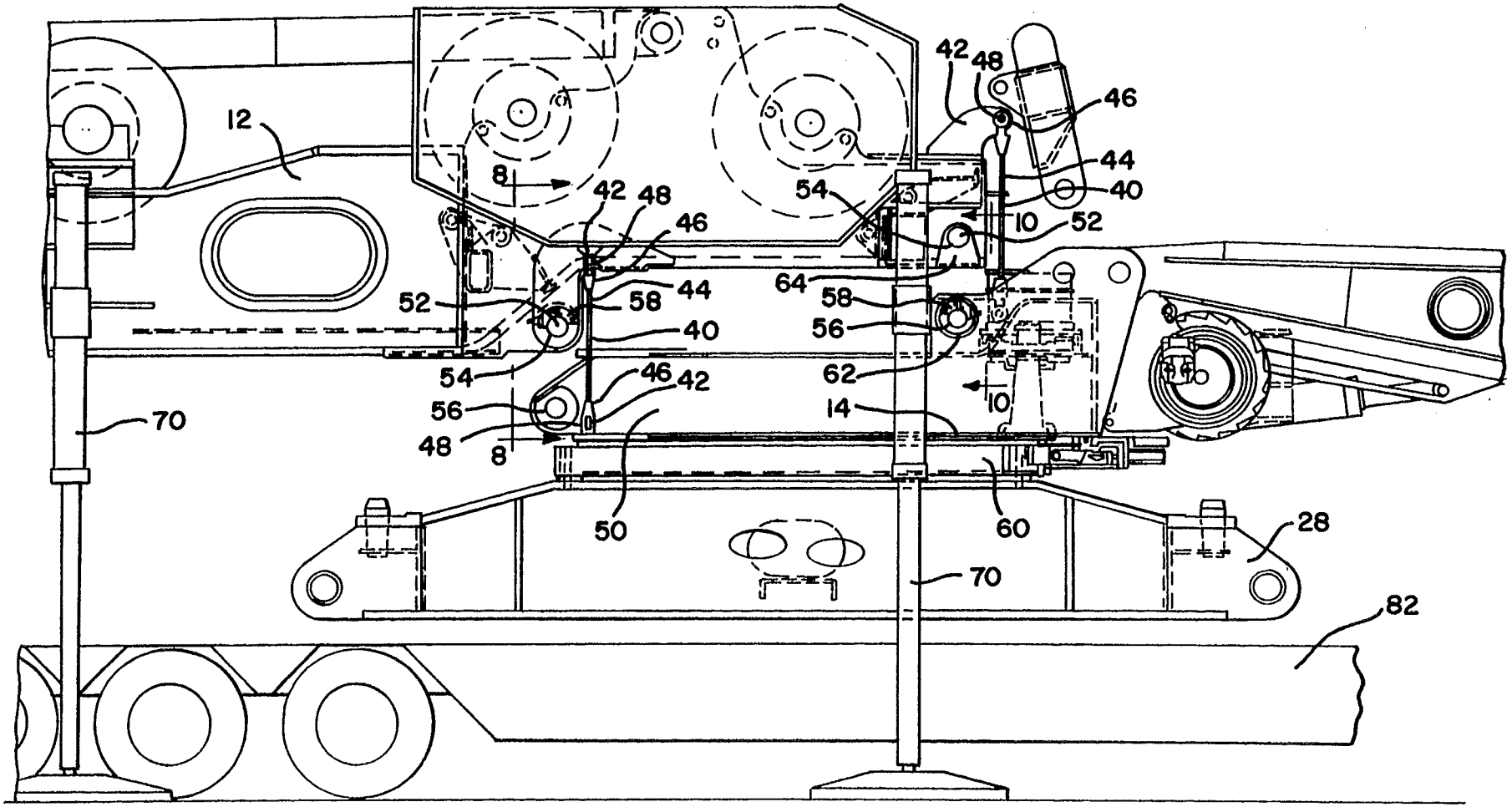
FIG. 6 is a right side perspective view of the lower works assembly suspended from the upper works assembly.
Figure 10:
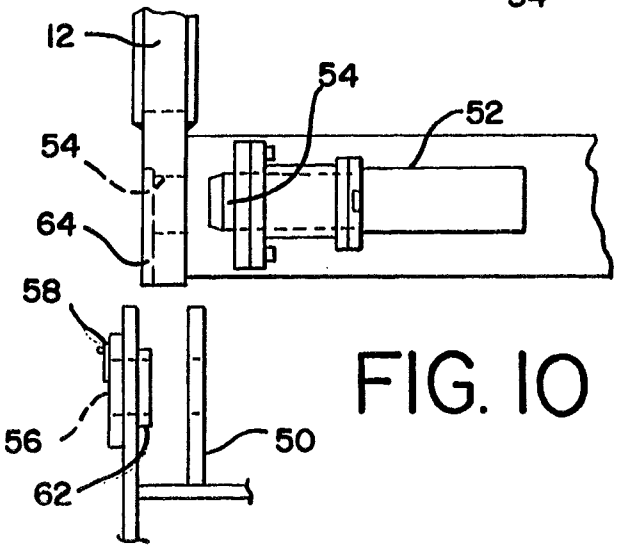
FIG. 10 is a sectional view of a front pendant assembly taken along line 10—10 of FIG. 6.

As best seen in FIGS. 6 and 10, the pinning holes 56 near the front of the adapter frame 50 further comprise a bushing 62 which corresponds to a notch 64 in upper works 12. The width of the notch 64 is greater at the bottom of the upper works 12 to allow some lateral misalignment between the upper works 12 and the lower works 14. The bushing 62 and notch 64 functions to guide the pinning hole 56 into exact alignment with the movable pin 54 when the upper works 12 is lowered onto the lower works 14. The notch 64 and bushing 62 also function to prevent the upper works 12 from being lowered too far.

Figure 8:
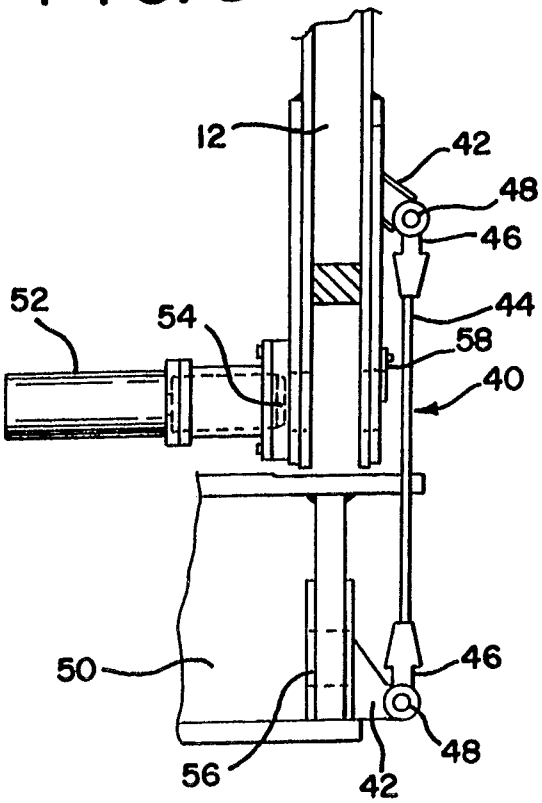
FIG. 8 is a sectional view of a rear pendant assembly taken along line 8—8 of FIG. 6.

As best seen in FIGS. 6 and 8, for aligning the upper works 12 with the lower works 14 to permit their redecking, the lower works 14 is suspended from the upper works 12 by an alignment system which utilizes the influence of gravity to level the lower works 14 and align the vertical axis of the lower works 14 with the vertical axis of the upper works 12. Rotational alignment is also obtained. The alignment system accomplishes this without transferring any weight from the upper works 12 to the lower works 14 during the redecking process. In the preferred embodiment shown, the alignment system comprises four pendants 40 which are pivotally connected between the upper works 12 and an adapter frame 50. The adapter frame 50 is attached to the swing bearing 60, which in turn is attached to the car body 28. The crawlers 30 (not shown) have been disconnected and removed. A series of jacking cylinders 70 are attached to the upper works 12 and support both the upper works 12 and the suspended lower works 14 during the redecking process.

The pendants 40 function to suspend the lower works 14 from, and in alignment with, the upper works 12 and may be of any design which will adequately carry the weight of the lower works 14. The pendants 40 must also have sufficient flexibility to permit the lower works 14 to pendulum from the upper works 12 under the influence of gravity. The pendants 40 are releasably connected between brackets 42 on the upper works 12 and on the adapter frame 50. The brackets 42 are located such that the vertical axis of the lower works 14 will align with the vertical axis of the upper works 12 when the lower works 14 is suspended from the upper works 12. The brackets 42 are also located such that they are reasonably accessible during the redecking process and will not interfere with the operation of the reassembled crane 10. In the preferred embodiment shown, each of the brackets 42 on the upper works 12 is aligned on a vertical axis with, and at an equal distance from, the corresponding bracket 42 on the adapter frame 50 when the vertical axis of the upper works 12 is aligned with the vertical axis of the lower works 14. This arrangement permits each pendant 40 to be of equal length and design.

The pendants 40 are sufficiently flexible to permit connection to the brackets 42 whenever the upper works 12 and the lower works 14 are in general alignment. The pendants 40 are also sufficiently flexible to permit redecking of the upper works 12 to the lower works 14 without the need to disconnect or remove the pendants 40. In the preferred embodiment shown, each of the pendants 40 is comprised of a flexible wire rope 44 with sockets 46 at each end. The sockets 46 are releasably connected to the brackets 42 by a removable pin 48. Of course, the pendants 40 may be of any design or number which will pendulum the lower works 14 from the upper works 12. For instance, the pendants may comprise a series of three or more rods which retract into sleeves during redecking. Or the rods themselves may be telescoping.

The jacking cylinders 70 may be of any design which will adequately function to raise, level, support and lower the upper works 12 during the redecking process. The jacking cylinders 70 must be of sufficient design and capacity to also raise, support and lower the additional weight of the lower works. The jacking cylinders 70 must also be designed so that they will not interfere with the redecking process or the operation of the assembled crane 10. In the preferred embodiment shown, two jacking cylinders 70 are connected to each side of the upper works 12 at a sufficient distance away from the upper works 12 to permit positioning of the lower works 14 under and in general alignment with the upper works 12.

In the preferred embodiment, the jacking cylinders 70 are designed to operate both independently and as a single unit. Independent operation permits leveling of the upper works 12 on uneven ground. Once leveled, the jacking cylinders 70 operate as a single unit to raise and lower the upper works 12 in a generally level manner during the redecking process. In the alternative, independent operation of the jacking cylinders 70 may be avoided through the use of cribbing or shims under the jacking cylinders 70 as required to level the upper works 12. In the preferred embodiment, the jacking cylinders 70 are hydraulically powered by the primary power source for the crane 10. The designs for hydraulically powered jacking cylinders 70 which operate both independently and in concert are within the knowledge of those skilled in the art.

Although the preferred embodiment shown employs an adapter frame 50 to facilitate the easy and rapid undecking and redecking of the upper works 12 to the lower works 14, the alignment system will function to align the assemblies regardless of the configuration or method used to connect the two assemblies. For instance, an adapter plate, as disclosed in application Ser. No. 07/556,840, now U.S. Pat. No. 5,176,267 the disclosure of which is hereby incorporated by reference, could be substituted for the adapter frame 50, or the adapter frame 150 could be relocated between the swing bearing 60 and the car body 28. In another embodiment, the upper works 12 may be disassembled from the lower works 14 by disconnecting the swing bearing 60, thereby eliminating the adapter frame 50 altogether. In that embodiment, the lower ends of the pendants 50 would be connected to the car body 28.

The preferred method for aligning and reassembling the upper works 12 with the lower works 14 of the crawler crane 10 of the preferred embodiment is best seen by referring to FIGS. 4 through 7 and the description above.

Figure 4:
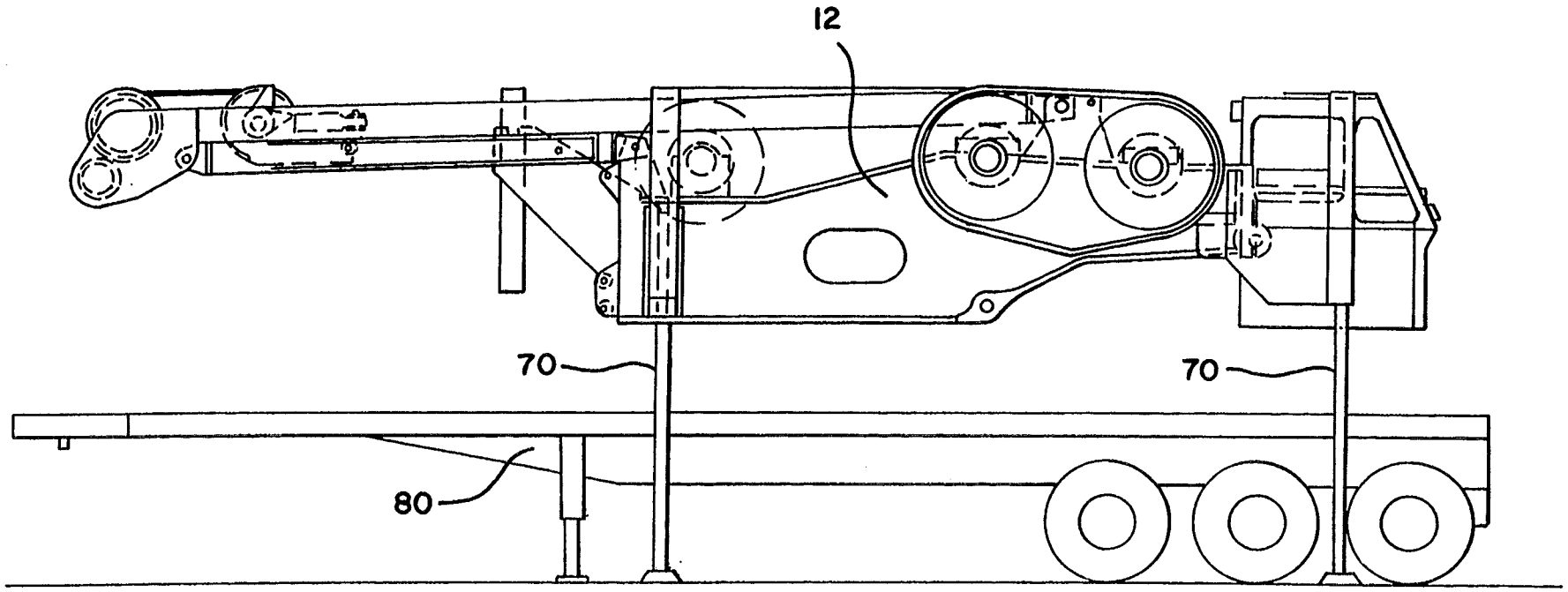
FIG. 4 is a right side perspective view of the upper works assembly supported on a plurality of hydraulic jacks.

As best seen in FIG. 4, the upper works 12 is supported in a generally level manner. In the preferred embodiment shown, the upper works 12 is raised up off of the upper works transport trailer 80 and leveled by extending the jacking cylinders 70. The upper works transport trailer 80 is then removed from beneath the upper works 12. In the preferred embodiment, the upper works 12 is leveled by independently extending each of the jacking cylinders 70 to compensate for any unevenness of the ground.

Figure 5:
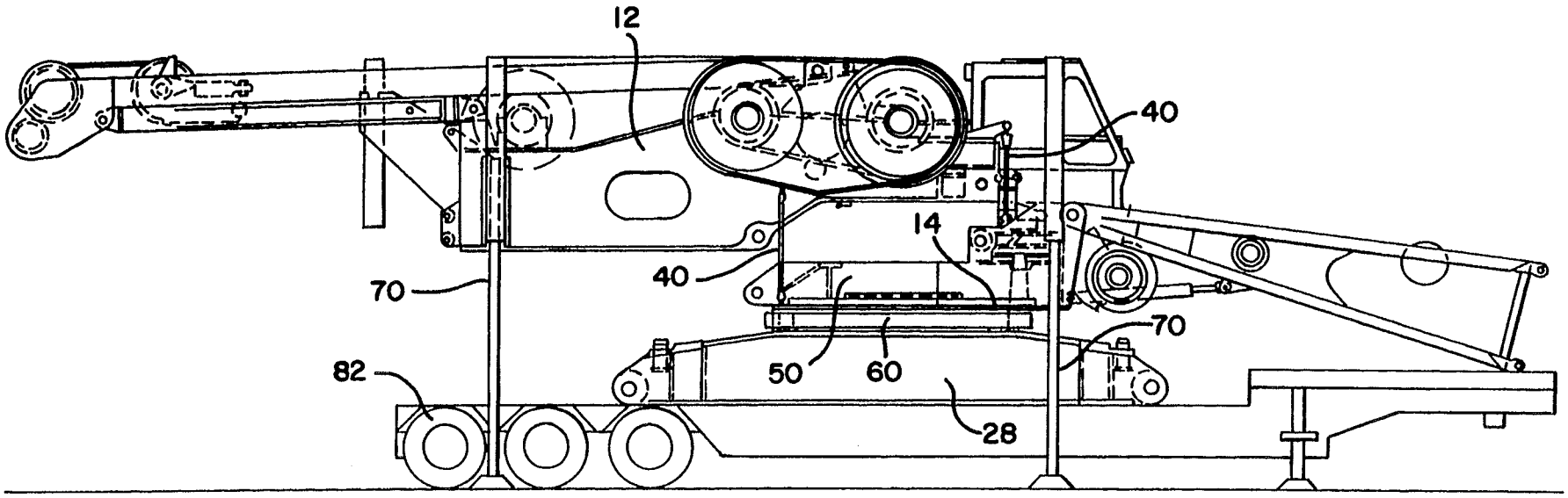
FIG. 5 is a right side perspective view of the lower works assembly positioned beneath and in general alignment with the upper works assembly.

As best seen in FIG. 5, the lower works 14 is placed beneath and in general alignment with the upper works 12. In the preferred embodiment shown, the lower works 14 is backed in on the lower works transport trailer 82 beneath and in general alignment with the upper works 12. The lower works transport trailer 82 can be sufficiently maneuvered with ordinary driver skill.

A means for suspending the lower works 14 from the upper works 12 is then attached. In the preferred embodiment shown, a series of pendants 40 are pivotally connected between the upper works 12 and the adapter frame 50. It may be necessary to lower the upper works 12 to facilitate the attachment of the pendants 50.

As best seen in FIG. 6, the jacking cylinders 70 are then extended to raise the upper works 12 in a generally level manner, thereby suspending the lower works 14 by the pendants 40, which act as suspending means, in a generally level manner. The vertical axis of the lower works 14 will then pendulum into alignment with the vertical axis of the upper works 12 under the influence of gravity.

As best seen in FIG. 7, the upper works 12 is finally redecked with the lower works 14. In the preferred embodiment shown, the jacking cylinders 70 are contracted to lower the upper works 12 and the suspended lower works 14 until the lower works 14 rests once again on the lower works transport trailer 82. It may be necessary to shim beneath the lower works 14 to maintain horizontal and vertical alignment. The jacking cylinders 70 are further contracted to lower the upper works 12 until the hydraulically actuated movable pins 54 on the upper works are horizontally aligned with the pinning holes 56 on the adapter frame 50. The pendants 40 flex to allow the upper works 12 to mate with the lower works 14. The upper works 12 is supported by the jacking cylinders 70 and does not bear any weight on either the lower works 14 or the lower works transport trailer 82. The hydraulically actuated movable pins 54 are then extended through the pinning holes 56, and locked into position by the latch plates 58, to connect the upper works 12 to the adapter frame 50 and complete redecking.

The redecked upper works 12 and lower works 14 may then be raised by extending the jacking cylinders 70 to permit the removal of the lower works transport trailer 82. Reassembly of the crawlers 30 to the car body 28 may then follow, as well as reassembly of the remaining components to the upper works. A method and apparatus for reassembling a crawler crane are disclosed in the aforementioned application entitled, "Self-Assembling and Self-Disassembling Crawler Crane," Ser. No. 07/762,767.

Of course, the steps of the preferred method described above can be modified or rearranged to suit various equipment or conditions. For instance, the lower works transport trailer 82 can be removed while the lower works 14 is suspended from the upper works 12. The aligned lower works 14 would then be lowered directly onto the ground, or onto cribbing, to complete redecking. In another embodiment, the upper works 12 could remain stationary while jacking cylinders 72 raise and lower the lower works 14 to align and redeck the assemblies.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope.

I claim:

1. A method for aligning the upper works of a crane to the lower works of a crane to facilitate redecking the upper works to the lower works, the lower works comprising a car body supporting a swing bearing, which comprises the steps of:

a) supporting said crane upper works in a generally level manner;

b) placing said crane lower works beneath and in general alignment with said upper works;

c) attaching a means for suspending said lower works beneath and from said upper works;

d) suspending said lower works by said suspending means;

e) aligning said lower works with said upper works through the influence of gravity on said lower works; and f) redecking said upper works with said lower works.

2. The method of claim 1 wherein said crane upper works is supported by a plurality of jacking cylinders.

3. The method of claim 1 wherein said means for suspending said lower works beneath and from said upper works comprises a plurality of pendants pivotally connected between said upper works and said lower works, said pendants of sufficient strength to carry the weight of said lower works.

4. The method of claim 3 wherein said plurality of pendants are sufficiently flexible to permit redecking of said upper works to said lower works without disconnecting or removing said pendants.

5. The method of claim 4 wherein each of said plurality of pendants comprises flexible wire rope.

6. The method of claim 1 wherein the step of redecking said upper works with said lower works comprises pinning said upper works to an adapter frame supported on said swing bearing.

7. A method for aligning the upper works of a crane to the lower works of a crane to facilitate redecking the upper works to the lower works, the lower works comprising a car body supporting a swing bearing, which comprises the steps of:

a) supporting said crane upper works on a plurality of jacking cylinders, the upper works being supported in a generally level manner;

b) placing said crane lower works beneath and in general alignment with said upper works;

c) attaching a plurality of pivotally connected flexible wire rope pendants between said upper works and said lower works;

d) raising said upper works with respect to said lower works so as to suspend said lower works by said pendants;

e) aligning said lower works with said upper works through the influence of gravity on said lower works;

f) lowering said upper works with respect to said lower works onto said aligned lower works; and g) redecking said upper works with said lower works.

8. The method of claim 7 wherein said raising of said upper works with respect to said lower works is accomplished by raising said upper works.

9. The method of claim 8 wherein said raising of said upper works is accomplished by extending each of said plurality of jacking cylinders.

10. The method of claim 7 wherein said lowering of said upper works with respect to said lower works is accomplished by lowering said upper works.

11. The method of claim 8 wherein said lowering of said upper works is accomplished by contracting each of said plurality of jacking cylinders.

12. The method of claim 7 wherein said alignment of said upper works to said lower works is accomplished without bearing weight of said upper works on said lower works.

13. The method of claim 7 wherein the step of redecking said upper works with said lower works comprises pinning said upper works to an adapter frame supported on said swing bearing.

14. In a crane having an upper works including a boom and rigging means, a powered mobile lower works with a swing bearing adapted to rotatively support said upper works, a system for aligning said upper and lower work to permit their redecking, comprising:

a) a plurality of jacking cylinder means mounted on said upper works for supporting, raising and lowering said upper works;

b) a plurality of flexible pendants, each pendant having a first and second end, means for pivotally and releasably connecting one end of each of said flexible pendants to said upper works;

c) means attached to said swing bearing and releasably connected to said upper works for redecking said upper and lower works; and d) means for connecting the other ends of the respective pendants to said attached means.

15. In a crane having an upper works including a boom and a rigging, and a powered mobile lower works with a swing bearing adapted to rotatively support said upper works, a system for aligning said upper and lower works to permit their redecking, comprising:

a) an adapter frame attached to said swing bearing and releasably connected to said upper works for redecking said upper and lower works;

b) a plurality of jacking cylinders mounted on said upper works for supporting, raising and lowering said upper works; and c) a plurality of flexible pendants, each pendant having a first and second end, each of said first ends pivotally connected to said upper works, and each of said second ends pivotally connected to either said lower works or said adapter frame, at least one of said first and second ends of each pendant being releasably connected to the respective upper works, lower works or adapter frame.

16. The crane of claim 15 wherein each of said plurality of pendants is sufficiently flexible to permit redecking of said upper works to said lower works without disconnecting or removing said pendants.

17. The crane of claim 15 wherein said pendants comprise flexible wire rope.

18. The crane of claim 15 wherein each of said pendants hang vertically between said upper works and said lower works when said upper works and said lower works are aligned.

19. The crane of claim 15 wherein the boom is connected to the adapter frame.

20. The crane of claim 15 wherein the adapter frame is releasably connected to the upper works by pins.

* * * * *

UNITED STATES PATENT AND TRADEMARK OFFICE

CERTIFICATE OF CORRECTION

PATENT NO. : 5,427,256
DATED : June 27, 1995
INVENTOR(S) : Terry W. Kleppe

It is certified that error appears in the above-indentified patent and that said Letters Patent is hereby corrected as shown below:

On the Title Page

Item [56],"References Cited U.S. Patent DOCUMENTS", please delete the following:

"4,508,232 4/1985 Lampson".

In column 6, line 23, after "in" insert --co-pending--.

In column 6, line 24, after "5,176,267" insert --,--.

In the Claims

Column 9,

In claim 14, line 5, delete "work" and substitute --works--.

Signed and Sealed this

Ninth Day of July, 1996

Bruce Lehman

*Attest:*

BRUCE LEHMAN

*Attesting Officer*

*Commissioner of Patents and Trademarks*